US006430937B2

(12) United States Patent
Cho et al.

(10) Patent No.: US 6,430,937 B2
(45) Date of Patent: Aug. 13, 2002

(54) VORTEX GENERATOR TO RECOVER PERFORMANCE LOSS OF A REFRIGERATION SYSTEM

(75) Inventors: Young I. Cho, Cherry Hill, NJ (US); Cheolho Bai, Taegu (KR)

(73) Assignee: VAI Holdings, LLC, Cherry Hill, NJ (US)

( * ) Notice: Subject to any disclaimer, the term of this patent is extended or adjusted under 35 U.S.C. 154(b) by 0 days.

(21) Appl. No.: 09/802,763

(22) Filed: Mar. 8, 2001

Related U.S. Application Data

(63) Continuation-in-part of application No. 09/760,232, filed on Jan. 12, 2001, and a continuation-in-part of application No. 09/737,016, filed on Dec. 14, 2000, and a continuation-in-part of application No. 09/535,126, filed on Mar. 24, 2000, and a continuation-in-part of application No. 09/517,922, filed on Mar. 3, 2000, now Pat. No. 6,250,086.

(51) Int. Cl.[7] ..... F25B 9/02; F25B 1/00
(52) U.S. Cl. ..... 62/5; 62/498
(58) Field of Search ..... 62/5, 498

(56) References Cited

U.S. PATENT DOCUMENTS

| | | | | | |
|---|---|---|---|---|---|
| 2,489,680 | A | | 11/1949 | Shoemaker et al. | 62/115 |
| 2,698,525 | A | * | 1/1955 | Lindenblad | 62/5 |
| 2,920,457 | A | | 1/1960 | Bartlett | 62/5 |
| 3,287,924 | A | * | 11/1966 | Bright | 62/5 |
| 3,600,904 | A | | 8/1971 | Tilney | 62/196 |
| 3,775,988 | A | | 12/1973 | Fekete | 62/23 |
| 3,902,876 | A | | 9/1975 | Moen et al. | 55/348 |
| 4,026,120 | A | | 5/1977 | Tallant | 62/5 |
| 4,136,528 | A | | 1/1979 | Vogel et al. | 62/174 |
| 4,290,791 | A | | 9/1981 | Matsui et al. | 55/399 |
| 4,302,949 | A | | 12/1981 | Longhetto | 62/402 |
| 4,331,002 | A | | 5/1982 | Ladusaw | 62/505 |
| 4,531,371 | A | | 7/1985 | Voronin et al. | 62/5 |
| 4,646,524 | A | * | 3/1987 | Kawashima et al. | 62/5 |
| 4,747,756 | A | | 5/1988 | Sato et al. | 417/307 |
| 5,186,137 | A | | 2/1993 | Salzmann | 123/192.2 |
| 5,426,956 | A | | 6/1995 | Philippe | 62/509 |
| 5,704,219 | A | | 1/1998 | Suzuki et al. | 62/222 |
| 5,706,666 | A | | 1/1998 | Yamanaka et al. | 62/225 |
| 5,976,227 | A | | 11/1999 | Lorey | 96/209 |
| 5,996,360 | A | | 12/1999 | Tanaka et al. | 62/160 |
| 6,006,541 | A | | 12/1999 | Taylor | 62/453 |
| 6,006,544 | A | | 12/1999 | Watanabe | 62/511 |
| 6,158,237 | A | * | 12/2000 | Riffat et al. | 62/484 |
| 6,250,086 | B1 | * | 6/2001 | Cho et al. | 62/5 |

FOREIGN PATENT DOCUMENTS

| | | | |
|---|---|---|---|
| DE | 832762 | 1/1952 | |
| DE | 8327962 | 2/1952 | |
| GB | 516375 | 1/1940 | |
| GB | 771785 | 4/1957 | |
| JP | 54-7647 | 1/1979 | 62/5 |
| JP | 5126426 A | 5/1993 | |
| JP | 8303879 A | 11/1996 | |
| JP | 8313072 | 11/1996 | |
| JP | 8313096 A | 11/1996 | |
| JP | 8320157 A | 12/1996 | |
| JP | 10141792 A | 5/1998 | |
| JP | 11193968 A | 7/1999 | |
| SU | 1726928 | 4/1992 | 62/5 |

OTHER PUBLICATIONS

Brochure from Newman Tools Inc.
Brochure from Air Research Technology Company.
Brochure from Filtan, Inc.

* cited by examiner

*Primary Examiner*—William C. Doerrler
(74) *Attorney, Agent, or Firm*—Mark A. Garzia

(57) ABSTRACT

The performance of a refrigeration system is often reduced due to insufficient refrigerant charge or due to the use of an inverter compressor. The performance loss is associated with the operating condition, which is not at the optimum, thus yielding less than the maximum EER (energy efficiency ratio). A vortex generator restores the optimum operating condition in the refrigeration system with insufficient refrigerant charge or using an inverter compressor.

8 Claims, 12 Drawing Sheets

Fig. 1 Prior Art: Conventional refrigeration system 30
33
12
25
13
Compressed vapor in
20
12
3B
30
33
13
16
14
3B
Liquid droplet
25
Vapor and liquid out Step 2: Vapor at core expands and cools, converting to liquid. Volume decreases by a factor of 100, creating vacuum.

Step 3: Liquid is thrown out by the centrifugal force. Vacuum is required for continuous operation of vortex generator.

Step 1: Vortex flow is produced in a vortex generator.

Prior Art: Conventional vortex generator

Fig. 10: EER vs. Refrigerant Charge Amount

VORTEX GENERATOR TO RECOVER PERFORMANCE LOSS OF A REFRIGERATION SYSTEM

CROSS REFERENCE TO RELATED APPLICATIONS

This application is a continuation-in-part of U.S. application Ser. No. 09/517,922 filed Mar. 3, 2000, now U.S. Pat. No. 6,250,086, entitled HIGH-EFFICIENCY REFRIGERATION SYSTEM; and a continuation-in-part of U.S. application Ser. No. 09/535,126 filed Mar. 24, 2000, entitled HIGH-EFFICIENCY REFRIGERATION SYSTEM; and a continuation-in-part of U.S. application Ser. No. 09/737,016 filed on Dec. 14, 2000, entitled VORTEX GENERATOR; and a continuation-in-part of U.S. application Ser. No. 09/760,232 filed Jan. 12, 2001, entitled METHOD AND APPARATUS FOR INCREASING THE EFFICIENCY OF A REFRIGERATION SYSTEM, all in the names of Young I. Cho and Cheolho Bai.

FIELD OF THE INVENTION

The present invention relates generally to refrigeration systems (including refrigerators, air conditioners, heat pumps and water coolers/chillers) and, more specifically, to a means and method for increasing the efficiency of a refrigeration system that is not operating at peak efficiency.

BACKGROUND OF THE INVENTION

A refrigeration system typically consists of four major components connected together via a conduit (preferably copper tubing) to form a closed loop system. Referring to FIG. 1, a conventional refrigeration system 500 is illustrated. The four major components are a compressor 52, a condenser 54, an expansion device 56 and an evaporator 58. A refrigerant circulates through the four components via the conduit 59 and will have its pressure either increased or decreased, and its temperature either increased or decreased by the four components. The refrigerant is continuously cycled through the refrigeration system. The main steps in the refrigeration cycle are compression of the refrigerant by the compressor 52, heat rejection of the refrigerant in the condenser 54, throttling of the refrigerant in the expansion device 56, and heat absorption of the refrigerant in the evaporator 58. This process is sometimes referred to as a vapor-compression refrigeration cycle. The compressor 52 includes a motor (usually an electric motor) and provides the energy to keep the refrigerant moving within the conduits and through the major components.

The vapor-compression refrigeration cycle is the principle upon which conventional air conditioning systems, heat pumps, and refrigeration systems are able to cool and dehumidify air in a defined volume (e.g., a living space, a vehicle, a freezer, etc.) The vapor-compression cycle is made possible because the refrigerant is a condensible gas and exhibits specific properties when it is placed under varying pressures and temperatures.

During the refrigeration cycle, the refrigerant enters the compressor as saturated vapor and is therein compressed to a very high pressure. The temperature of the refrigerant increases during the compression step. The refrigerant leaves the compressor as superheated vapor and enters the condenser.

A typical condenser comprises a single conduit formed into a serpentine-like shape so that a plurality of rows of conduit are formed parallel to each other. Metal fins or other aids are usually attached to the outer surface of the serpentine conduit in order to increase the transfer of heat between the superheated refrigerant vapor passing through the condenser and the ambient air. Heat is rejected from the superheated vapor as it passes through the condenser and the refrigerant exits the condenser as a saturated or subcooled liquid.

The expansion device reduces the pressure of the liquid refrigerant thereby turning it into a saturated liquid-vapor mixture, which is throttled to the evaporator. In order to reduce manufacturing costs, the expansion device is typically a capillary tube in small air conditioning systems. The temperature of the refrigerant drops below the temperature of the ambient air as it passes through the expansion device. The refrigerant enters the evaporator as a low quality saturated mixture comprised of approximately 20% vapor and 80% liquid. ("Quality" is defined as the mass fraction of vapor in the liquid-vapor mixture.)

The evaporator physically resembles the serpentine-shaped conduit or coils of the condenser. The evaporator also includes fins or other means of increasing the surface area of the serpentine-shaped conduit. Ideally, the refrigerant n the evaporator completely evaporates by absorbing heat from the defined volume to be cooled (e.g., the interior of a refrigerator) and leaves the evaporator as saturated vapor at the suction pressure of the compressor and reenters the compressor thereby completing the cycle.

The efficiency of a refrigeration cycle is traditionally described by an energy-efficiency ratio (EER). It is defined as the ratio of the heat absorption from an evaporator to the work done by a compressor.

$$EER = \frac{\text{Heat absorption from evaporator}}{\text{Work done by compressor}}$$

In a typical air conditioning system, the refrigeration cycle has an EER of approximately 3.0 (kw/kw) or 10.2 (Btu/hr/kw). As can be seen from the EER equation, the efficiency of the refrigeration system increases by decreasing the work performed by the compressor.

In recent years, compressor manufacturers have made strides in improving the overall efficiency of a refrigeration system by improving the efficiency of the compressor. Two important advancements in compressor efficiency were achieved with the development of scroll compressors and with the improvement in control circuitry of the compressors.

The motors in previous compressors ran at a single speed (usually at a very high speed). Both inverter compressors and digital scroll compressors include circuitry that allows the compressor motor to vary its speed depending on load conditions. By designing a control system that allows the compressor motor to increase speed during high load periods and to decrease speed during low load periods, the overall work done by a variable-speed compressor is reduced, thereby increasing the overall efficiency of the refrigeration system. (It should be noted that fans driven by electric motors are usually associated with the condenser and the evaporator for drawing air over and/or through the respective serpentine-shaped coils. The electric fan motors may also be variably-speed controlled to correspond with the output of the compressor and further increasing the overall efficiency of a refrigeration system.)

When the compressor motor is operating at a very high speed (and usually when it operates at a very slow speed)

versus an optimum speed, the efficiency of the refrigeration system is not at its peak. Therefore, even though variable speed compressor motors may increase the overall efficiency of a refrigeration system, there are certain periods of operation where the efficiency may still be increased.

In addition, the U.S. Department of Energy has expressly identified the problem of incorrect charge of refrigerant circulating in refrigeration/air conditioning systems as a major source of inefficiency. The amount of refrigerant in a refrigeration system is not optimized (i.e., usually low or insufficient) primarily because the refrigeration technicians undercharge the system during installation or do not properly read the gauges during the maintenance of a refrigeration system. A refrigeration system that is undercharged will not perform up to its specified EER claims and may also severely decrease the life-span of a compressor.

Vortex tubes are well known. Typical vortex tubes are designed to operate with non-condensible gas such as air. A typical vortex tube turns compressed air into two air streams, one of relatively hot air and the other of relatively cold air. A common application for prior vortex tubes is in air supply lines and other applications which utilize gas under a high pressure.

A vortex tube does not have any moving parts. A vortex tube operates by imparting a rotational vortex motion to an incoming compressed air stream; this is done by directing compressed air into an elongated channel in a tangential direction.

SUMMARY OF THE INVENTION

The present invention addresses the issue of performance degradation in a refrigeration system due to an insufficient charge of refrigerant or during periods of high load in a variable speed compressor (e.g., inverter compressor or digital scroll compressor). For example, when an inverter compressor is used in a small air-conditioning refrigeration system, the degree of the sub-cooling in the refrigerant after it exits the condenser decreases from its optimum value of 11 degrees Celsius (C) to about 5–6 degrees Celsius. As a result, the EER of this refrigeration system typically decreases from 10.0 to 8.0 (Btu/hr/kW). A similar decrease in efficiency is found in refrigeration systems utilizing digital scroll compressors.

Also, when there is a loss of refrigerant or an insufficient charge of refrigerant, the degree of the sub-cooling in the refrigerant after condensing by the condenser decreases from its optimum value of 11 degrees C to about 5–6 degrees C for a small air-conditioning refrigeration system. Again, the EER decreases from an optimum value of about 10.0 to about 8.0 (Btu/hr/kW) for this small air-conditioning/refrigeration system.

The present invention is designed to recover the maximum efficiency of a refrigeration, air conditioning or heat pump system (collectively referred to as refrigeration systems) during periods when it is not operating at peak efficiency. The increase in the efficiency is achieved by assisting in the conversion of the refrigerant from vapor to liquid at specific points in the refrigeration cycle.

In many present day refrigeration systems, an inverter compressor or a digital scroll compressor is used to increase the overall efficiency of the refrigeration system. However, there are periods when the efficiency of the refrigeration system is lower than at other periods.

In a preferred embodiment of the present invention, a first vortex generator is placed in the condenser about one-quarter of the way in from the inlet of the condenser (i.e., either in the serpentine tubing of the condenser or by splitting the condenser into a ¼ length section and a ¾ length section). A vortex generator is designed to work specifically with condensible vapors such as refrigerants.

Ideally, the vortex generator is placed at a point where the desuperheating is completed (i.e., at a point where the superheated vapor becomes saturated vapor in whole or in part). The vortex generator produces liquid refrigerant and further increases the temperature of the vapor refrigerant thereby reducing the size of the condenser and decreasing the head pressure of the compressor. As a result, the compression ratio decreases, and the work required by the compressor is reduced, thus increasing the efficiency of the refrigeration cycle.

In an alternate embodiment, a vortex generator is placed between the expansion device and the evaporator in order to increase the percentage of refrigerant entering the evaporator as a liquid. Since the heat absorption from the evaporator occurs through the evaporation of the liquid refrigerant, the increase in the percentage of the liquid refrigerant entering the evaporator increases the efficiency of the refrigeration cycle and reduces the size requirements of the evaporator.

In addition to the one or two vortex generators described above, other embodiments may include a second (or third if both of the aforementioned vortex generators described above are used) vortex generator placed between the evaporator and the compressor in order to increase the percentage of refrigerant entering the compressor as a vapor.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF PREFERRED EMBODIMENTS

In describing preferred embodiments of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Figure 1:
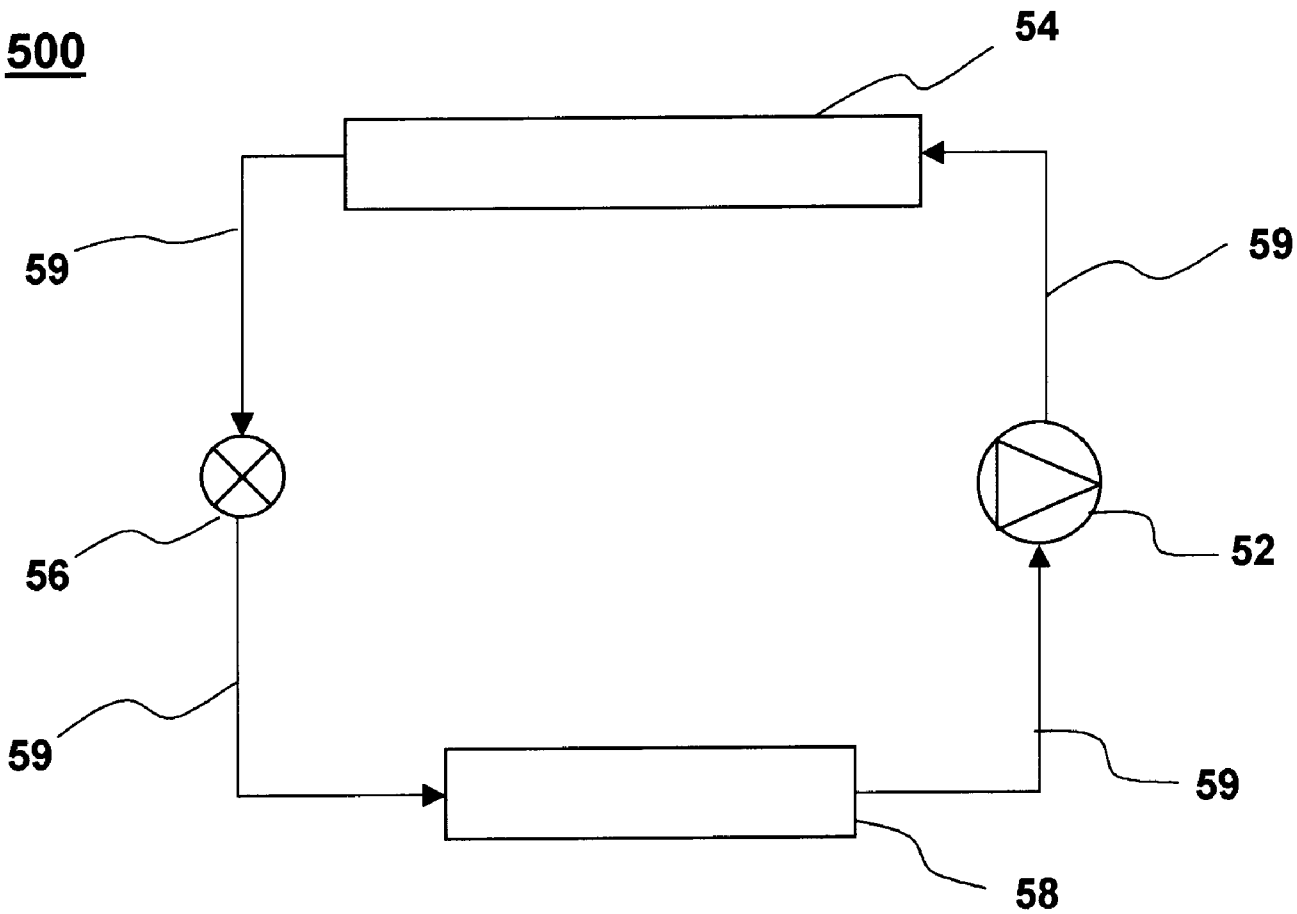
FIG. 1 is a block diagram of a conventional refrigeration system.

Preferred embodiments of the present invention will now be described in detail with reference to the accompanying drawings in which a refrigeration system in accordance with the present invention is generally indicated at 10. (See FIG. 2.) A typical refrigeration system 500 is illustrated in FIG. 1. The refrigeration system includes a compressor 52, a condenser 54, an expansion device 56 and an evaporator 58. The various components are connected together via a conduit (usually copper tubing) 59.

The refrigeration system 500 is a closed loop system that continuously circulates a refrigerant through the various elements. The refrigerant is a condensible vapor. Some common types of refrigerant include R-12, R-22, R-134A, R-410A, ammonia, carbon dioxide and natural gas. The main steps in the refrigeration cycle are compression of the refrigerant by the compressor 52, heat rejection of the refrigerant in the condenser 54, throttling of the refrigerant in the expansion device 56, and heat absorption of the refrigerant in the evaporator 58. As indicated previously, this process is referred to as the vapor compression refrigeration cycle.

The efficiency of a refrigeration cycle (and by analogy a heat pump cycle) depends primarily on the heat absorption from the evaporator 58 and the efficiency of the compressor 52. The former depends on the percentage of liquid in the liquid-vapor refrigerant mixture before the evaporator, whereas the latter depends on the magnitude of the pressure differential across the compressor.

A compressor is a device to increase pressure from low to high values by compressing gas or vapor, which is usually done by consuming electric energy. The pressure of the refrigerant as it enters the compressor is referred to as the suction pressure level and the pressure of the refrigerant as it leaves the compressor is referred to as the head pressure level. Depending on the type of refrigerant used, the head pressure can range from about 170 PSIG (i.e., 11.6 atm) to about 450 PSIG (i.e., 30.6 atm).

Compression ratio is the term used to express the pressure ratio between the head pressure and the suction pressure. Compression ratio is calculated by converting the head pressure and the suction pressure onto an absolute pressure scale and dividing the head pressure by the suction pressure. When the compression ratio increases, the compressor efficiency drops thereby increasing energy consumption.

The work of a compressor, W, is mathematically defined as:

$$W = \int_1^2 v\,dP$$

where v is specific volume, P is pressure, subscripts 1 and 2 indicate inlet (suction side) and outlet (discharge side), respectively. As indicated by the above equation, the compressor work is proportional to pressure differential, ÄP or $P_2$-$P_1$.

The compressor work in a typical refrigeration system can be simplified for an isentropic process as:

$$W = \frac{kRT_1}{k-1}\left[\left(\frac{P_2}{P_1}\right)^{(k-1)/k} - 1\right]$$

where k is a specific heat ratio, R is a gas constant, and T is temperature. As depicted in the above equation, the compressor work can be reduced by reducing the pressure differential, $P_2$-$P_1$ or compression ratio, $P_2/P_1$ As the compressor work is reduced, the EER (energy efficiency ratio) increases because EER is defined as the ratio of the heat absorption at the evaporator to compressor work.

When a compressor runs at a high compression ratio, the compressor efficiency decreases and the compressor work increases. As the compressor efficiency drops, more electricity is used for less refrigeration. Furthermore, running the compressor at a high compression ratio increases the wear and tear on the compressor and decreases its operating life.

An evaporator 58 is made of a long coil or a series of heat transfer panels which absorb heat from a volume of air that is desired to be cooled. In order to absorb heat from this ambient volume, the temperature of the refrigerant must be lower than the temperature of the volume of air to be cooled. The refrigerant exiting the expansion device 56 consists of low quality vapor, which is approximately 20% vapor and 80% liquid in a typical refrigeration system.

The liquid portion of the refrigerant is used to absorb heat from the desired volume as the liquid refrigerant evaporates inside the evaporator. The vapor portion of the refrigerant is not utilized to absorb heat from the ambient volume. In other words, the vapor portion of the refrigerant does not contribute to cooling the ambient volume and decreases the efficiency of the refrigeration cycle.

Referring again to FIG. 2, the present invention utilizes a vortex generator 20 in the condenser in a refrigeration (including a heat pump) system that has an inverter compressor 152. The motor of an inverter compressor 152 is designed to change speed depending on the load on the compressor.

Vortex tubes are well-known in other areas of art but are not commonly found in refrigeration systems. Vortex tubes are specifically designed for use with non-condensible gases such as air. Vortex tubes separate the non-condensible gas into a relatively hot vapor stream and a relatively cool vapor stream.

A vortex generator is new and is specifically designed for use with condensible vapors such as refrigerants. Vortex generators are more fully disclosed and described in our co-pending U.S. application Ser. No. 09/737,016 filed on Dec. 14, 2000 entitled VORTEX GENERATOR. U.S. application Ser. No. 09/737,016 is hereby incorporated by reference as if set forth fully herein; however, a description follows.

Moreover, vortex generators used to improve the efficiency of a refrigeration system is described in our co-pending application U.S. application Ser. No. 09/760,232 filed Jan. 12, 2001, entitled METHOD AND APPARATUS FOR INCREASING THE EFFICIENCY OF A REFRIGERATION SYSTEM. U.S. application Ser. No. 09/760,232 is also hereby incorporated by reference as if set forth fully herein.

Figures 3A, 3B:
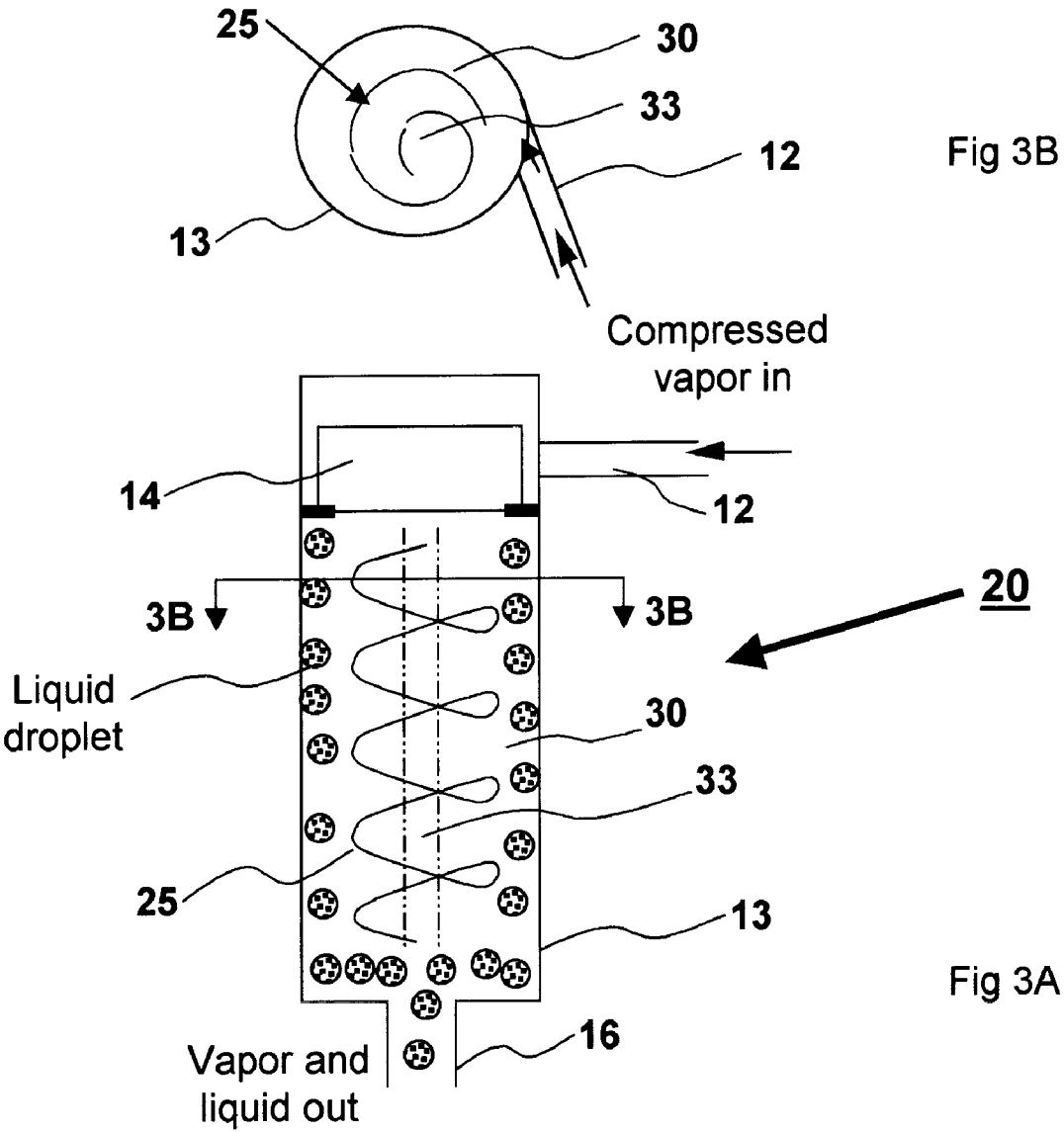
FIG. 3A is a side cross-sectional view of a single-inlet, single-outlet vortex generator utilizing a tangential feed in the nozzle.
FIG. 3B is a top cross-sectional view of the vortex generator shown in FIG. 3A.

FIG. 3A is a cross-sectional view of a "basic" vortex generator 20 in accordance with the present invention. The vortex generator 20 includes an elongated or longitudinal chamber 30, an inlet 12, a nozzle 14, and an outlet 16. Its single inlet and its single outlet usually identify this embodiment of a vortex generator 20.

Although the longitudinal chamber 30 is shown as substantially tubular in shape and is defined by sidewall 13, it is believed that other designs (e.g., oval) may be utilized.

Condensible vapor enters the vortex generator 20 at inlet 12. The condensible vapor is under a high pressure (i.e., compressed). The nozzle 14 is fixed with respect to the sidewall 13 of the longitudinal chamber 30; there are no moving parts in the vortex generator 20. The nozzle 14 is designed to direct the incoming vapor in a tangential direction with respect to the sidewall 13 of the longitudinal chamber 30.

As a result of the injection of vapor in a tangential direction, a vortex-shaped vapor stream 25 is produced within the longitudinal chamber 30. The vortex-shaped vapor stream 25 (sometimes referred to as cyclonic- or spiral-shaped) created by the nozzle 14 is illustrated in FIGS. 3A and 3B. The operation of the nozzle 14 will be more thoroughly discussed in connection with the description of FIGS. 6A, 6B and 6C.

Referring now to FIG. 3B, near the core region 33 (i.e., parallel to the longitudinal axis) of the elongated chamber, a forced vortex flow is generated, where circumferential velocity linearly increases with the radial distance. Outwards from the core region, there is a free vortex, where circumferential velocity exponentially decreases along the radial distance. The vortex 25 has the general appearance of a spiral.

Figure 4B:
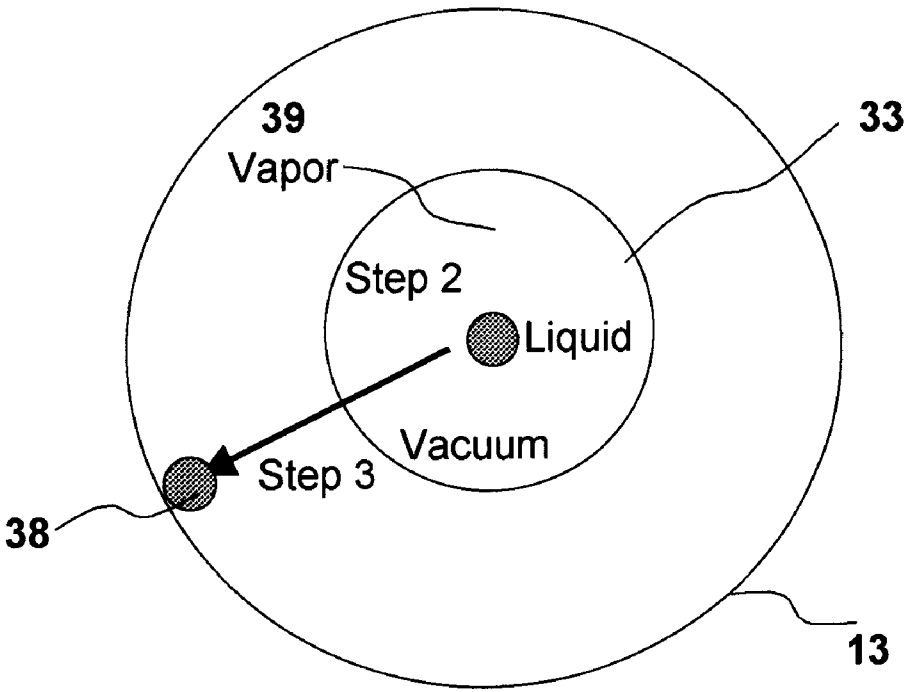
FIGS. 4A and 4B are diagrammatic representations illustrating the principle of phase-changing of the vapor inside the vortex generator of the present invention.
Figure 4A:
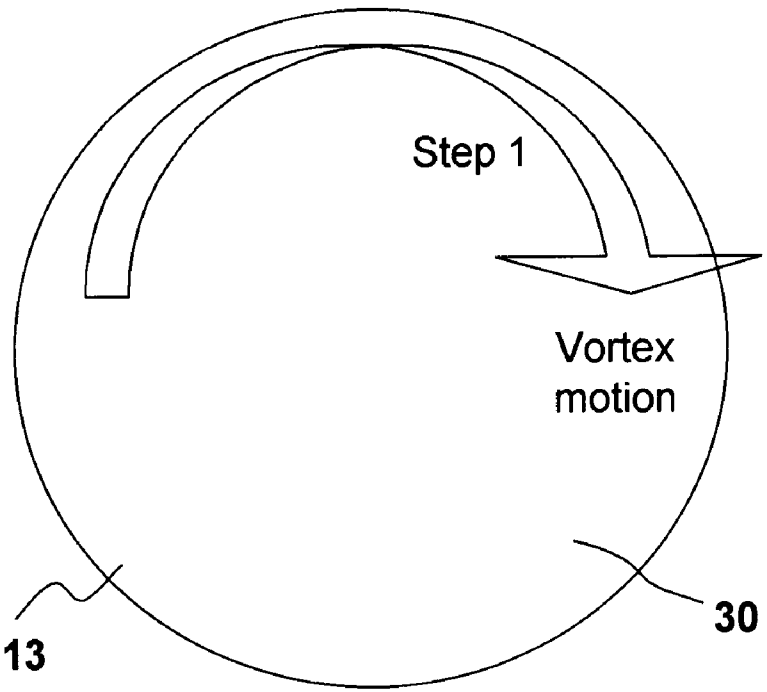

Referring now to FIGS. 4A and 4B, the vapor at the core expands due to the centrifugal force, thus reducing its temperature. In comparison, the vapor at the outer region is compressed as the vapor is pushed toward the sidewall by the centrifugal force, thus resulting in an increased temperature.

As condensible vapor enters a vortex generator 20, the vapor at the core 33 of the vortex generator 20 expands due to the vortex flow motion of the vapor, resulting in a localized drop in pressure. Subsequently, its temperature also drops, converting the condensible vapor to liquid (phase change). Initially, relatively small droplets of liquid are formed. As the phase change of the condensible vapor occurs, the volume of the condensible vapor shrinks because the volume of liquid is significantly smaller than that of vapor. For example, the volume of liquid water is about 1,000 times smaller than that of water vapor (i.e., steam). For typical refrigerants, such as R-22 and R-134a, the volume of the liquid is approximately 80–100 times smaller than that of the vapor.

Figure 5:
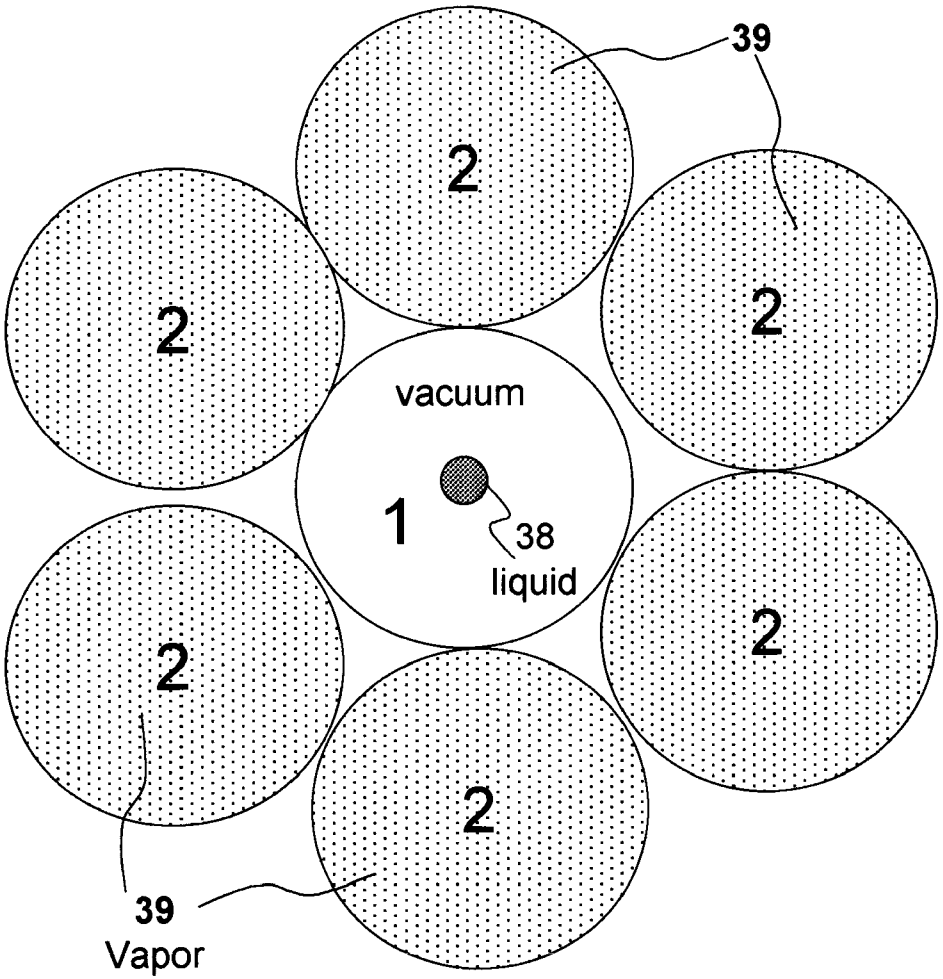
FIG. 5 is a representation of the cascade effect produced inside of a vortex generator in accordance with the present invention.

As a result of the vapor-liquid conversion, the volume of the condensible vapor decreases, prompting a significant drop in the local pressure. This sudden drop in pressure is essentially the same as what happens when the vapor suddenly expands. The sudden drop in the pressure accompanies a corresponding temperature drop, causing additional condensation around the initial condensed droplet. As a result, the condensible vapor is separated into a relatively cool liquid 38 and relatively hot vapor 39 as shown in FIG. 5.

Figure 6A:
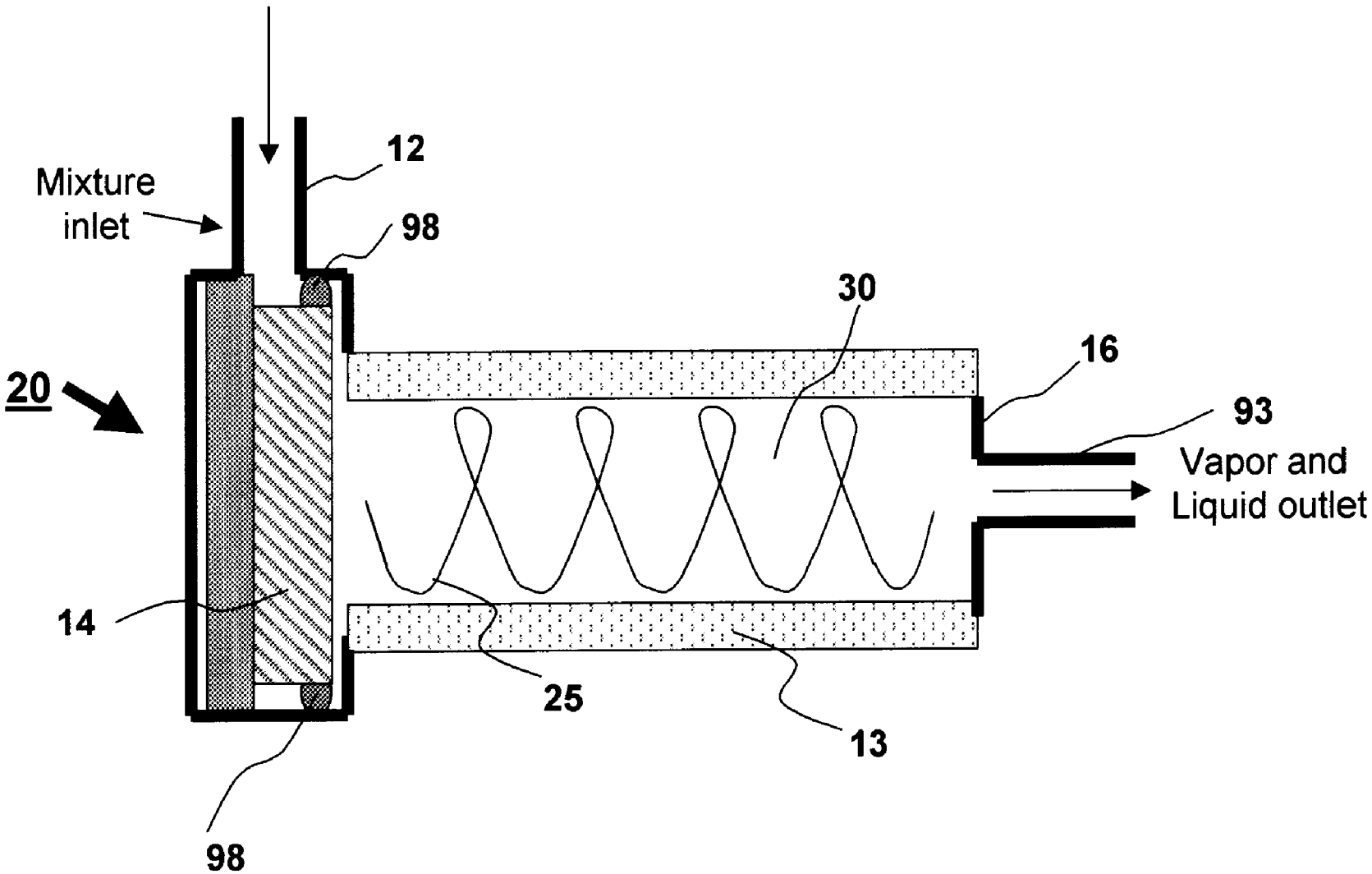
FIG. 6A is a more detailed view of the single-inlet, single outlet vortex generator illustrated in FIG. 3A.

Referring now to FIG. 6A, an enlarged cross-sectional view of the vortex generator 20 illustrated in FIGS. 3A and 3B is shown. The outlet 16 may just be an open end to the longitudinal chamber; however, as illustrated in FIG. 6A, an extension 93 may be used. Condensible vapor enters the vortex generator at inlet 12 at one end, and both condensed liquid and the remaining vapor exit through the other end. The nozzle 14 is stationary and is used to guide the condensible vapor into the vortex generator tangentially at the inlet so that the vapor can form a vortex flow in the longitudinal chamber 30 of the vortex generator. An O-ring 98 may be used to assist in securing the nozzle 14 within the vortex generator 20 and to ensure that all of the condensible vapor enters the elongated chamber 30 tangentially.

Figure 6C:
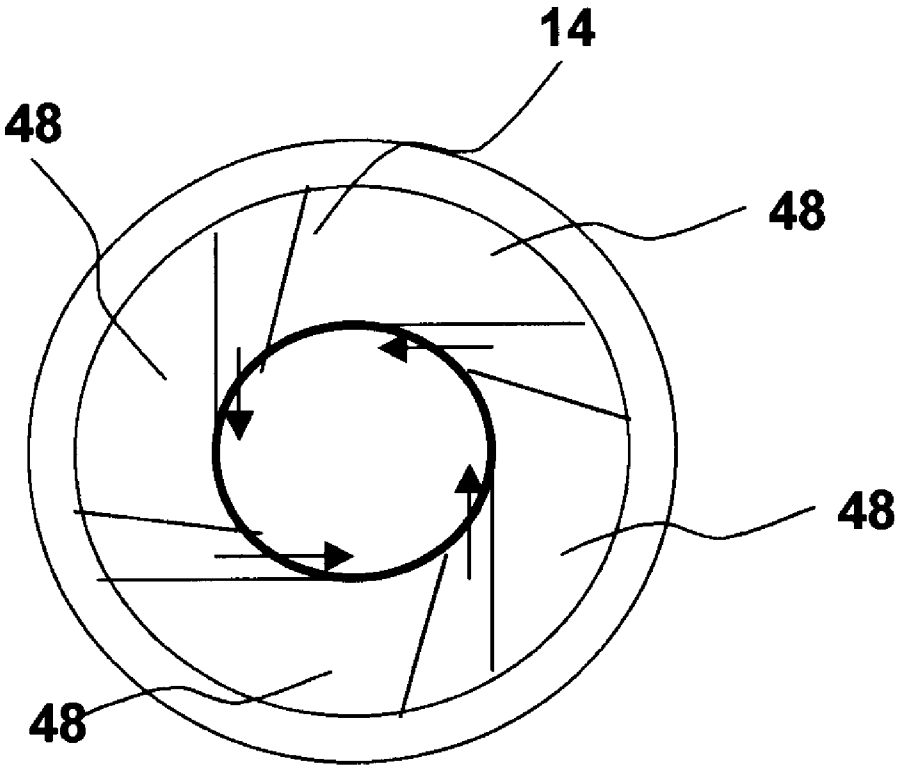
FIG. 6C is an end view, of a nozzle used in the vortex generator of FIG. 6A.
Figure 6B:
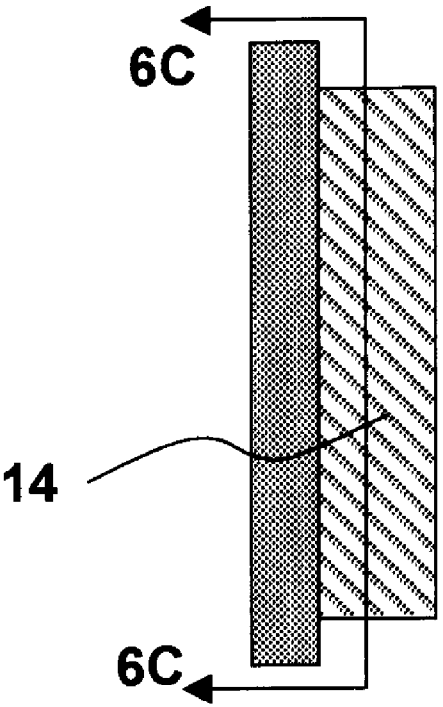
FIG. 6B is a side view.

The design of the nozzle 14 is shown in FIGS. 6B and 6C. A plurality of guide vanes 48 direct the tangential entry of the vapor into the longitudinal chamber 30 of the vortex generator. As indicated previously, there are no moving parts in a vortex generator and the nozzle 14 is stationary relative to the wall 13 of the vortex generator.

Referring again to FIGS. 4A and 4B, the principle of the phase-change within a vortex generator 20 is discussed. The condensation of condensible vapor inside a vortex generator 20 may be summarized in three steps. Step One, as illustrated in FIG. 4A, shows the vortex flow created by a nozzle 14 at the inlet of a vortex generator 20. Step Two, as illustrated in FIG. 4B, shows the vapor-to-liquid phase change and the creation of a vacuum in the core region; Step Three, also illustrated in FIG. 4B, shows the movement of a liquid droplet from the core to the sidewall of the vortex generator, which is the result of centrifugal force.

Liquid production as a result of a cascade effect inside a vortex generator will now be described. Referring again to FIG. 5, the portion of a condensible vapor is represented by region 1, having a temperature that reaches (or drops below) its saturation temperature due to the vortex motion near the inlet of the vortex generator. The vapor converts to liquid in region 1, causing the pressure in the adjacent area (indicated by 2) to drop, prompting a temperature drop and subsequent vapor-liquid conversion. Subsequently, the pressure in region 2 suddenly drops, and the vapor around region 2 is affected by the vacuum, prompting further vapor-liquid conversion. This cascade effect accelerates vapor-liquid conversion in the vortex generator.

The cascade effect is self-sustaining once the first liquid droplet is produced due to the vortex flow motion. In other words, if the vortex motion cannot be maintained, then cold and hot vapor become mixed, and the cascade effect of self-sustaining vapor-liquid conversion stops. In summary, one has to maintain the vortex flow structure to sustain this cascade process.

Figures 7A, 7B:
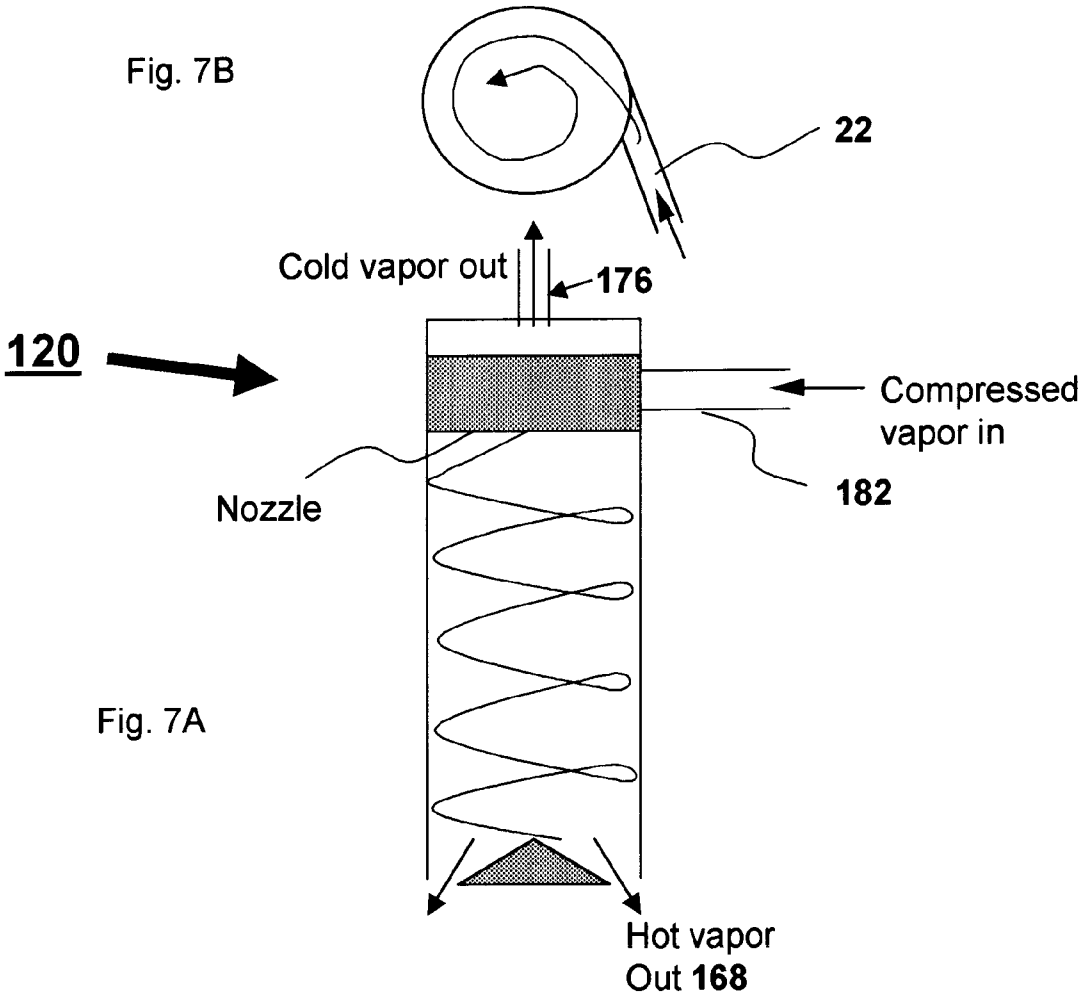
FIGS. 7A and 7B are a cross-sectional side view and a top view, respectively, of another embodiment of a vortex generator in accordance with the present invention using two inlets and two outlets.

FIGS. 7A and 7B illustrate an alternate embodiment of a vortex generator 120. Vortex generator 120 has one inlet and two outlets. The inlet 182 is similar to the inlet of the vortex generator 20 illustrated in FIGS. 3 and 6A.

The vortex generator 120 has a hot vapor outlet 168 and a cool vapor outlet 176. This alternate vapor generator 120 may be used as needed in other locations of a refrigeration system.

Referring again to FIG. 2, one embodiment of a refrigeration system with a modified condenser 114 is illustrated. Since the heat rejection from the condenser to its surroundings can occur only when the temperature of the refrigerant is greater than that of the surroundings, the refrigerant temperature has to be raised well above that of the surroundings. This is accomplished by raising the pressure of the refrigerant vapor, a task that is done by the inverter compressor 152. Since vapor temperature is closely related to vapor pressure, it is critically important that the condenser efficiently rejects heat from the refrigerant to the surroundings. If the condenser 114 is not efficient, the compressor 52 has to further increase the head pressure in an attempt to assist the condenser in dumping heat to the surroundings.

Figure 2:
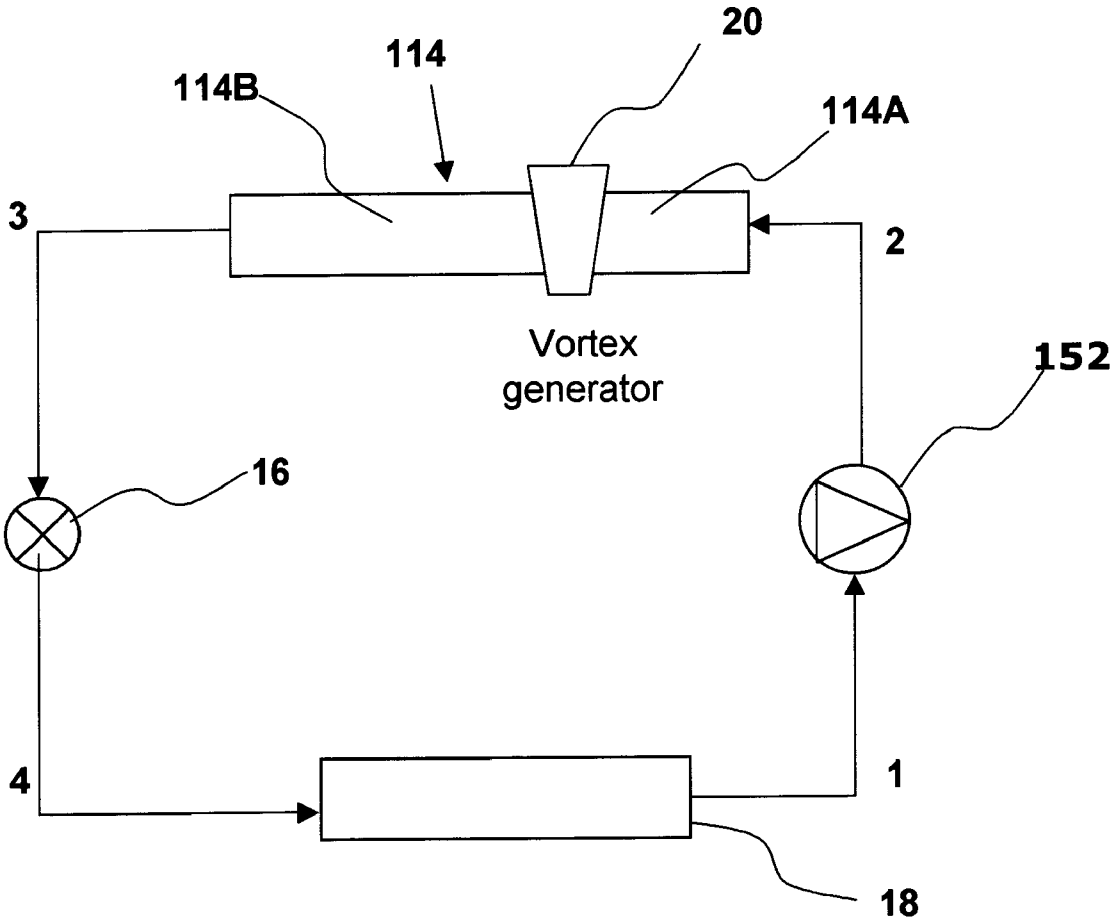
FIG. 2 is a block diagram of a refrigeration system (e.g., a refrigerating, air conditioning, or heat pump) having an inverter compressor and utilizing a vortex generator in accordance with the present invention.

As illustrated in FIG. 2, the present invention utilizes a vortex generator 20 in the condenser 114 to convert saturated refrigerant vapor to liquid thus increasing the condenser's efficiency. The first approximately one-quarter of the condenser is represented by 114A and the remaining approximately three-quarters of the condenser is represented by 114B.

A condenser 54 in a "typical" refrigeration system is used to convert superheated refrigerant vapor to liquid by rejecting heat to the surroundings. The condenser is a long heat transfer coil or series of heat rejecting panels similar in appearance to the evaporator. As refrigerant enters a "typical" condenser, the superheated vapor first becomes saturated vapor in the approximately first quarter-section of the condenser, and the saturated vapor undergoes a phase change in the remainder of the condenser at approximately constant pressure.

Figure 8:
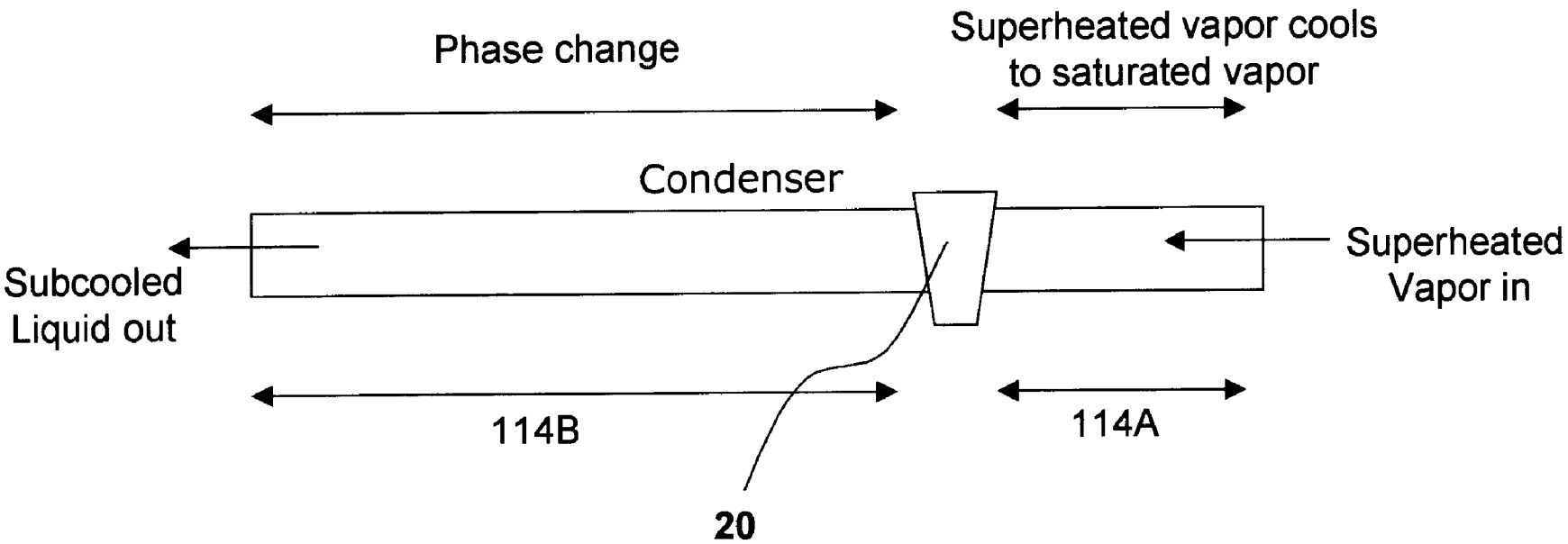
FIG. 8 is an enlarged block diagram illustrating the relative position of a vortex generator within a condenser in accordance with the present invention.

In this embodiment of the invention, the vortex generator 20 is inserted approximately one-quarter of the way into the condenser 114 (i.e., at the point where the superheated vapor becomes saturated vapor in full or in part). Referring now to FIG. 8, by inserting the vortex generator 20 in an existing condenser, manufacturing costs of the installation of the vortex generator 20 may be minimized. However, for all intents and purposes two separate condensers, each about the respective size of condenser portions 114A and 114B (i.e., about ¼ and ¾ of the size of the original condenser, respectively) may be used.

Referring again to FIGS. 2 and 8, when a vortex generator 20 is placed approximately one-fourth of the way from the inlet of the condenser, the temperature of the refrigerant does not have to be raised well over that of the surroundings thus allowing the compressor 152 to run at a lower head pressure than would be the case without the vortex generator 20.

Since the refrigerant vapor becomes saturated or subcooled liquid at the output of the condenser 114, the size of the condenser in prior art refrigeration systems is often chosen larger than necessary in order to ensure the exchange of heat. The present method allows the size of the condenser 114 to be reduced because the substantial amount of saturated refrigerant vapor is converted to liquid by the vortex generator 20. The present invention allows the use of a smaller condenser than is the case without a vortex generator 20 thereby reducing the size of air conditioning systems, refrigerators and heat pumps.

Figure 9:
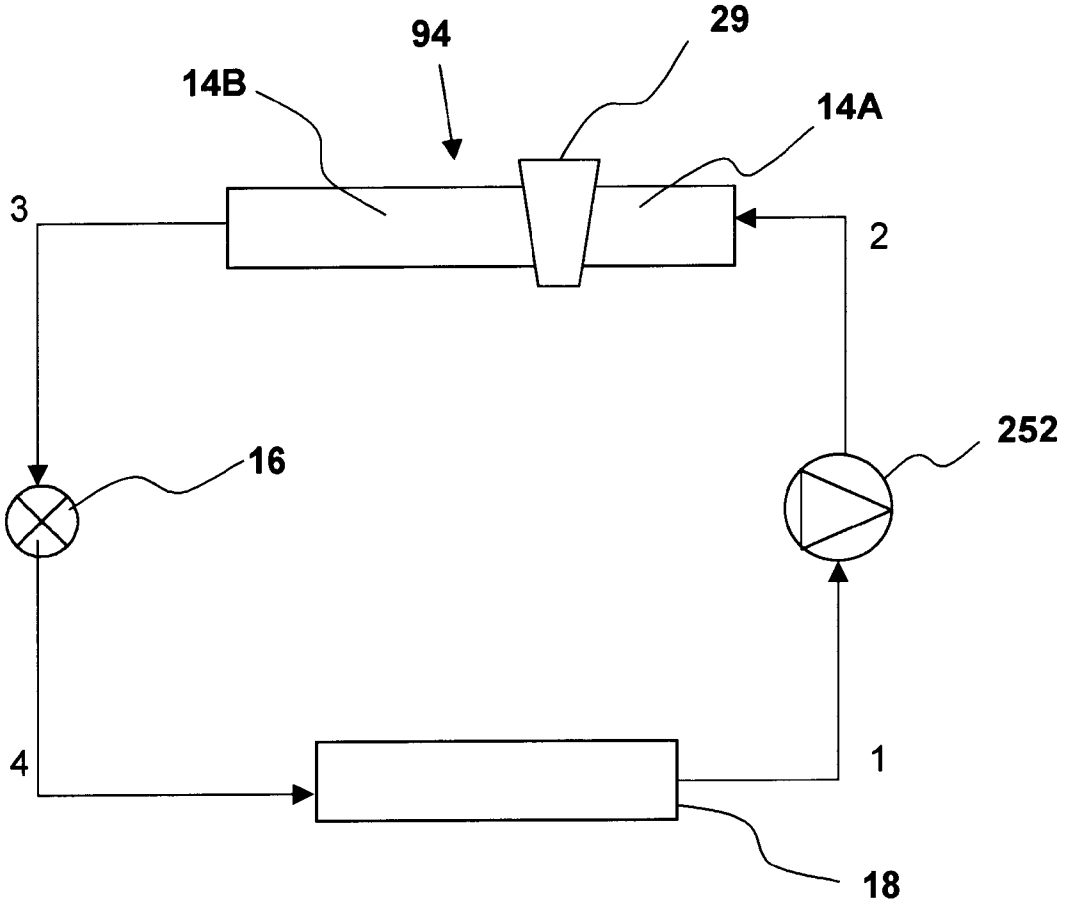
FIG. 9 is a block diagram of a refrigeration system having a digital scroll compressor and utilizing a vortex generator in accordance with the present invention.

Referring now to FIG. 9, another preferred embodiment is illustrated with a refrigeration system having a digital scroll compressor 252. As illustrated, the vortex generator 20 is again placed in the condenser 114 about one-quarter of the way in from the inlet.

The use of an inverter compressor 152 or a digital scroll compressor 252 significantly reduces the energy efficiency ratio (EER) of a refrigeration system. For example, the value of EER of a typical "small" room air-conditioner (e.g., less than one ton) with a compressor without an inverter is approximately 10.0 whereas the EER value for a system with an inverter compressor is typically about 8.0 (Btu/hr/kW). When the inverter compressor is used, the degree of subcooling in the refrigerant after condensation decreases from its optimum value of 1 degrees C. to about 5–6 degrees C., for example, for a small air-conditioning system. The use of a vortex generator increases the sub-cooling back to the optimum value of 11 degree C., thus restoring the maximum EER for the small air-conditioning system.

Figure 10:
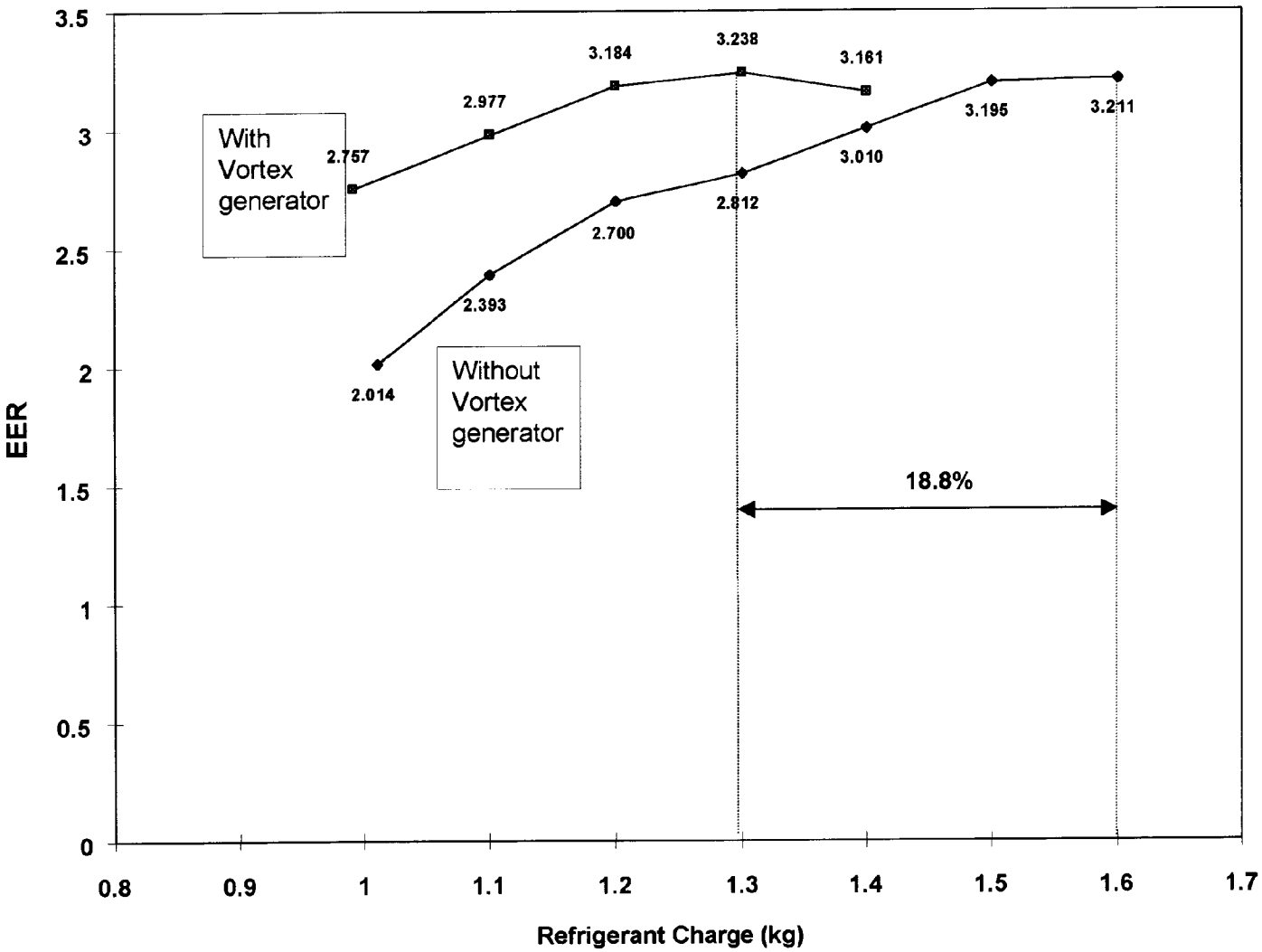
FIG. 10 is a graph comparing EER versus the amount of refrigerant charge in refrigeration system.

FIG. 10 is a graph comparing EER to refrigerant charge amount for a small air-conditioning system.

Similar to the use of an inverter compressor or a digital scroll compressor, when there is a loss of refrigerant (or an insufficient charge of refrigerant), the optimum EER value of 10.0 decreases to about 8.0 (Btu/hr/kw). This is because with a less than optimum refrigerant charge, the degree of the sub-cooling in the refrigerant after passing through the condenser decreases from its optimum value of 11 degrees C. to about 5–6 degrees C. for a small air-conditioning system. The use of a vortex generator increases the subcooling back to the optimum value of 11 degree C., thus restoring the maximum EER for the small air-conditioning system. Accordingly, when the cause of low efficiency in a refrigeration system is inadequate or under charging of refrigerant, the present invention can compensate by increasing the efficiency of the refrigeration system despite the lack of refrigerant.

Figure 11:
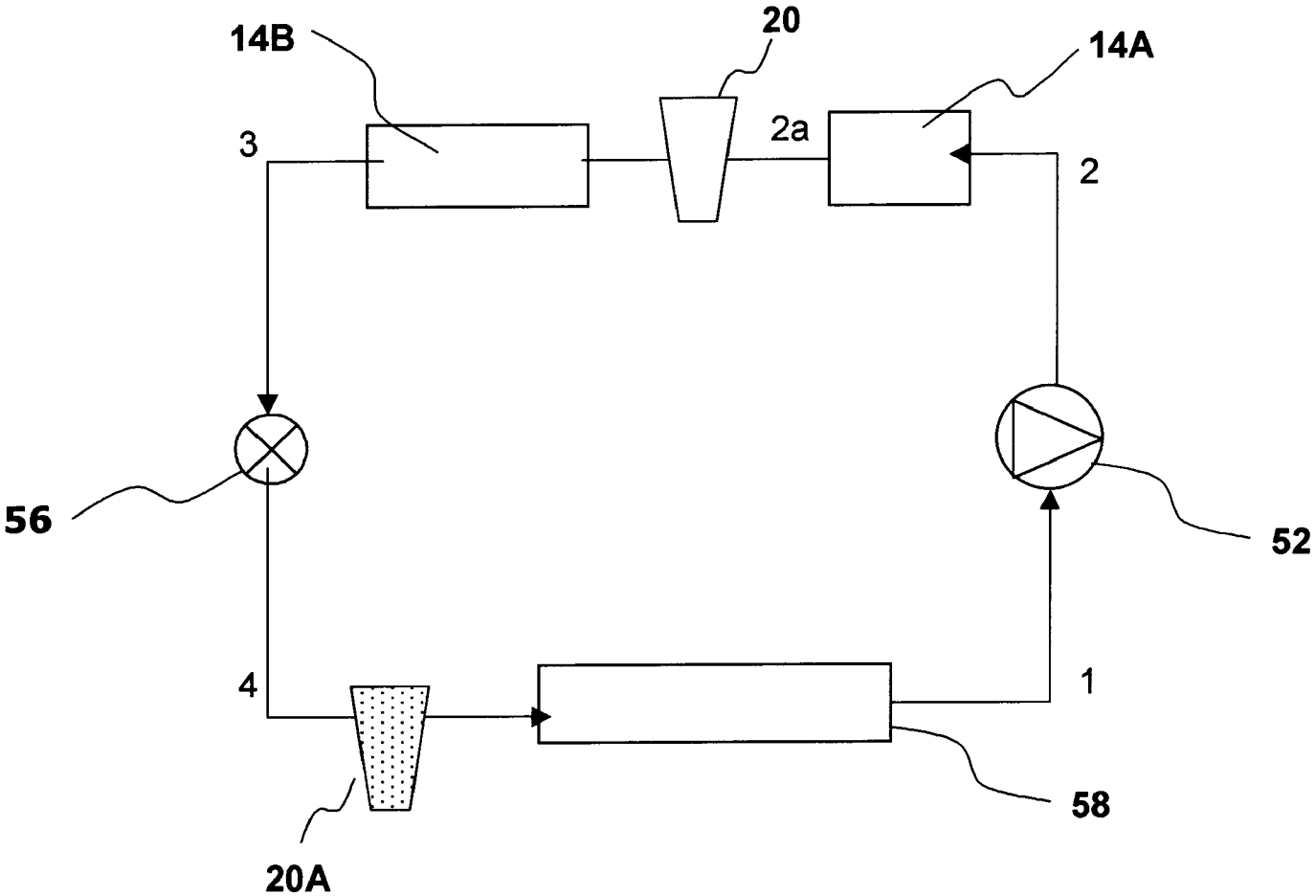
FIG. 11 is another embodiment of the present invention using two vortex generators.

FIG. 11 illustrates the use of a vortex generator 60 between the expansion device 56 and the evaporator 58. Vortex generator 60 converts at least a portion of the refrigerant vapor that exits the expansion device 56 into liquid so that it can be used in the evaporator 58 to absorb heat from the ambient volume.

Referring again to FIG. 11, a vortex generator 20A is placed into the closed loop refrigeration system after the expansion device 56. Refrigerant vapor-liquid mixture exits the expansion device 56 and enters the vortex generator 60 at the first or tangential inlet 82. The high pressure refrigerant mixture stream produces a strong vortex flow in the vortex generator 20A. The vortex flow is similar in shape to a helix or spiral. The high pressure refrigerant mixture separates into a vapor stream and a liquid stream both moving downstream along the helical path. From the vortex flow, the vapor stream gains a high velocity on the order of 100 m/s.

Since the heat absorption from the evaporator occurs through the evaporation of the liquid refrigerant, an increase in the percentage of the liquid refrigerant entering the evaporator increases the efficiency (EER) of the refrigeration cycle and reduces the size of the evaporator for the same BTU output (i.e., cooling capacity) refrigeration system.

In the embodiments illustrated in FIG. 11, an increase in the heat absorption is achieved since only the liquid refrigerant passes through evaporator 58; this results in an increase in efficiency (EER) of the refrigeration cycle.

FIG. 11 also illustrates the principle of two separate condensers 14A and 14B separated by a vortex generator 20.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

We claim:

1. A refrigerator system having a compressor, a condenser, an expansion device, and an evaporator each component having an inlet and an outlet, arranged in succession and connected in a closed loop in order to circulate refrigerant through the closed loop wherein said refrigeration system has a charge of refrigerant less than full, thereby causing said refrigeration system to operate at less than peak efficiency, the refrigeration system further comprising:

a vortex generator incorporated in and placed approximately one quarter of the way from the inlet of the condenser.

2. A refrigeration system having an inverter compressor having a variable speed control system for adjusting the speed of the compressor, a condenser, an expansion device, and an evaporator, each of said components having an inlet and an outlet, arranged in succession and connected in a closed loop in order to circulate refrigerant through the closed loop, said refrigeration system tending to operate at less than peak efficiency at a range of speeds proximate the inverter compressor's highest speed, said refrigeration system also tending to operate at less than peak efficiency at a range of speeds proximate the inverter compressor's slowest speed, the refrigeration system further comprising:

a vortex generator incorporated in and placed approximately one quarter of the way from the inlet of the condenser for increasing the efficiency of said refrigeration system when the inverter compressor operates proximate its highest speed, said vortex generator also increasing the efficiency of said refrigeration system when the inverter compressor operates proximate its slowest speed.

3. A refrigeration system having a digital scroll compressor having a variable speed control system for adjusting the speed of the compressor, a condenser, an expansion device, and an evaporator, each of said components having an inlet and an outlet, arranged in succession and connected in a closed loop in order to circulate refrigerant through the closed loop, said refrigeration system tending to operate at less than peak efficiency at a range of speeds proximate the digital scroll compressor's highest speed, said refrigeration system also tending to operate at less than peak efficiency at a range of speeds proximate the digital scroll compressor's slowest speed, the refrigeration system further comprising:

a vortex generator incorporated in and placed approximately one quarter of the way from the inlet of the condenser for increasing the efficiency of said refrigeration system when the digital scroll compressor operates proximate its highest speed, said vortex generator also increasing the efficiency of said refrigeration system when the digital scroll compressor operates proximate its slowest speed.

4. The refrigeration system of claim 3 wherein a second vortex generator is placed immediately before the inlet of the evaporator.

5. A refrigeration system comprising:

a compressor;

a first condenser;

a vortex generator;

a second condenser approximately three times as large as said first condenser;

an expansion device; and an evaporator, all arranged in succession and communicating via conduit to circulate a refrigerant in a closed loop for continued operation at a relatively high efficiency when a less than optimum amount of refrigerant is present in the refrigeration system.

6. The refrigeration system of claim 5 wherein the compressor is an inverter compressor.

7. The refrigeration system of claim 1 wherein said vortex generator comprises:

an elongated tube having an interior wall that defines a longitudinal chamber therein, said tube having a first end and a second end;

an inlet that depends proximate the first end of the longitudinal chamber for allowing refrigerant into said tube;

a nozzle designed to spin inside the chamber proximate the inlet, said nozzle directing the refrigerant in a tangential direction with respect to the interior walls of the tube thereby creating a vortex-shaped refrigerant vapor stream within said chamber; and at least one outlet for allowing the refrigerant to egress.

8. In a refrigeration system having a compressor, a condenser, an expansion device, and an evaporator, all arranged in succession and communicating via conduit to circulate refrigerant, a method of improving efficiency when a less than full charge of refrigerant is circulating through said conduit; the method comprising the step of:

inserting a vortex generator into the condenser at a point wherein at least a portion of a superheated refrigerant vapor becomes saturated vapor.

* * * * *

UNITED STATES PATENT AND TRADEMARK OFFICE

CERTIFICATE OF CORRECTION

PATENT NO. : 6,430,937 B2
DATED : August 13, 2002
INVENTOR(S) : Young I. Cho and Cheolho Bai It is certified that error appears in the above-identified patent and that said Letters Patent is hereby corrected as shown below:

Column 9,
Line 59, delete "1" and substitute therefor -- 11 --.

Signed and Sealed this

Fourteenth Day of September, 2004

JON W. DUDAS
*Director of the United States Patent and Trademark Office*